US008902139B2

(12) United States Patent
Lai

(10) Patent No.: US 8,902,139 B2
(45) Date of Patent: Dec. 2, 2014

(54) LED DISPLAY DEVICE WITH AUTOMATIC BRIGHTNESS ADJUSTMENT

(71) Applicant: Hon Hai Precision Industry Co., Ltd., New Taipei (TW)

(72) Inventor: Chih-Chen Lai, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 52 days.

(21) Appl. No.: 13/719,507

(22) Filed: Dec. 19, 2012

(65) Prior Publication Data

US 2013/0328754 A1 Dec. 12, 2013

(30) Foreign Application Priority Data

Jun. 8, 2012 (TW) ..... 101120787 A

(51) Int. Cl.
*G09G 3/32* (2006.01)
*G09G 3/34* (2006.01)

(52) U.S. Cl.
CPC ..... *G09G 3/32* (2013.01); *G09G 2320/068* (2013.01); *G09G 3/346* (2013.01); *G09G 2300/023* (2013.01); *G09G 2354/00* (2013.01); *G09G 2320/0626* (2013.01); *G09G 2360/144* (2013.01)
USPC ..... 345/82

(58) Field of Classification Search
USPC ..... 345/82, 84, 44
See application file for complete search history.

(56) References Cited

U.S. PATENT DOCUMENTS

| | | | | |
|---|---|---|---|---|
| 8,500,284 | B2 * | 8/2013 | Rotschild et al. | 353/10 |
| 2011/0228059 | A1 * | 9/2011 | Nagai | 348/54 |
| 2013/0077024 | A1 * | 3/2013 | Shikii et al. | 349/62 |

* cited by examiner

*Primary Examiner* — Fred Tzeng
(74) *Attorney, Agent, or Firm* — Novak Druce Connolly Bove + Quigg LLP

(57) ABSTRACT

A display device includes a housing, a screen mounted on the housing, an imagine capture unit, a distance measuring unit, and a display module assembly received in housing. The display module assembly includes a light emitting unit, a micro reflection unit, and a micro control unit; the micro control unit includes an identify module and a reflection control module. The identify module is electrically connected to the imagine capture unit and the distance measuring unit for receiving images of a viewer to identify position of eyes of viewer and sending instruction to measure distances between eyes of viewer and the display device to the distance measuring unit; the reflection control module is electrically connected to one of the light emitting unit and the micro control unit to control the micro reflection unit to rotate relative to the light emitting unit, to reflect light into eyes of the viewer.

12 Claims, 6 Drawing Sheets

LED DISPLAY DEVICE WITH AUTOMATIC BRIGHTNESS ADJUSTMENT

BACKGROUND

1. Technical Field

The present disclosure generally relates to display devices, and particularly to a display device capable of adjusting an illumination brightness of the display device according to a position of a viewer's line of sight.

2. Description of Related Art

The brightness in front of an LED display device is usually the greatest within a very narrow viewing angle of viewers, because the LED display devices generally emit light having directions that are straight out. Thus, viewers may feel that the brightness is non-uniform, and may also feel uncomfortable when they watch the displayed content on the LED display device after an extended period of time.

Therefore, there is room for improvement within the art.

SUMMARY

According to an embodiment of the invention, a display device is provided. The display device includes a housing, a screen, an imagine capture unit, a distance measuring unit, and a display module assembly. The screen is mounted on the housing. The imagine capture unit is positioned on the housing and is adjacent to the screen. The imagine capture unit is configured to capture images of a viewer. The distance measuring unit is positioned on the housing adjacent to the screen and spaced from the imagine capture unit. The distance measuring unit is configured to measure a distance between the eyes of the viewer and the display device. The display module assembly includes a light emitting unit, a micro reflection unit, and a micro control unit. The display module assembly is received in the housing. The micro control unit includes an identify module and a reflection control module. The identify module is electrically connected to the imagine capture unit and the distance measuring unit. The identify module receives image data from the imagine capture unit to identify the position of the eyes of the viewer and send an instruction to measure the distance between the eyes of the viewer and the display device to the distance measuring unit. The reflection control module is electrically connected to the distance measuring unit to receive the distance data for the distance between the viewer's eyes and the display device. The reflection control module is further electrically connected to the micro reflection unit to control the micro reflection unit to rotate relative to the light emitting unit, such that light emitted by the light emitting unit is reflected into the eyes of the viewer by being parallel to the line of sight of the viewer.

BRIEF DESCRIPTION OF THE DRAWINGS

The components in the drawings are not necessarily drawn to scale, the emphasis instead placed upon clearly illustrating the principles of the present disclosure. Moreover, in the drawings, like reference numerals designate corresponding parts throughout the several views.

DETAILED DESCRIPTION

Figure 1:
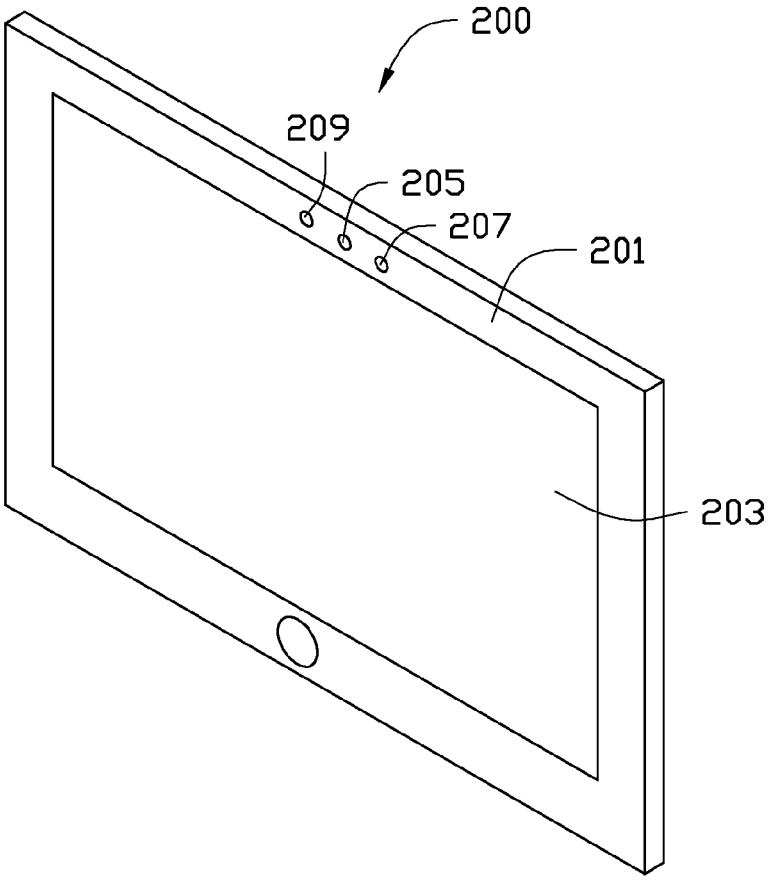
FIG. 1 shows an isometric view of a display device in accordance with a first embodiment of the present disclosure, including a screen, a plurality of LEDs and a plurality of micro-electro-mechanical system mirrors.
Figure 2:
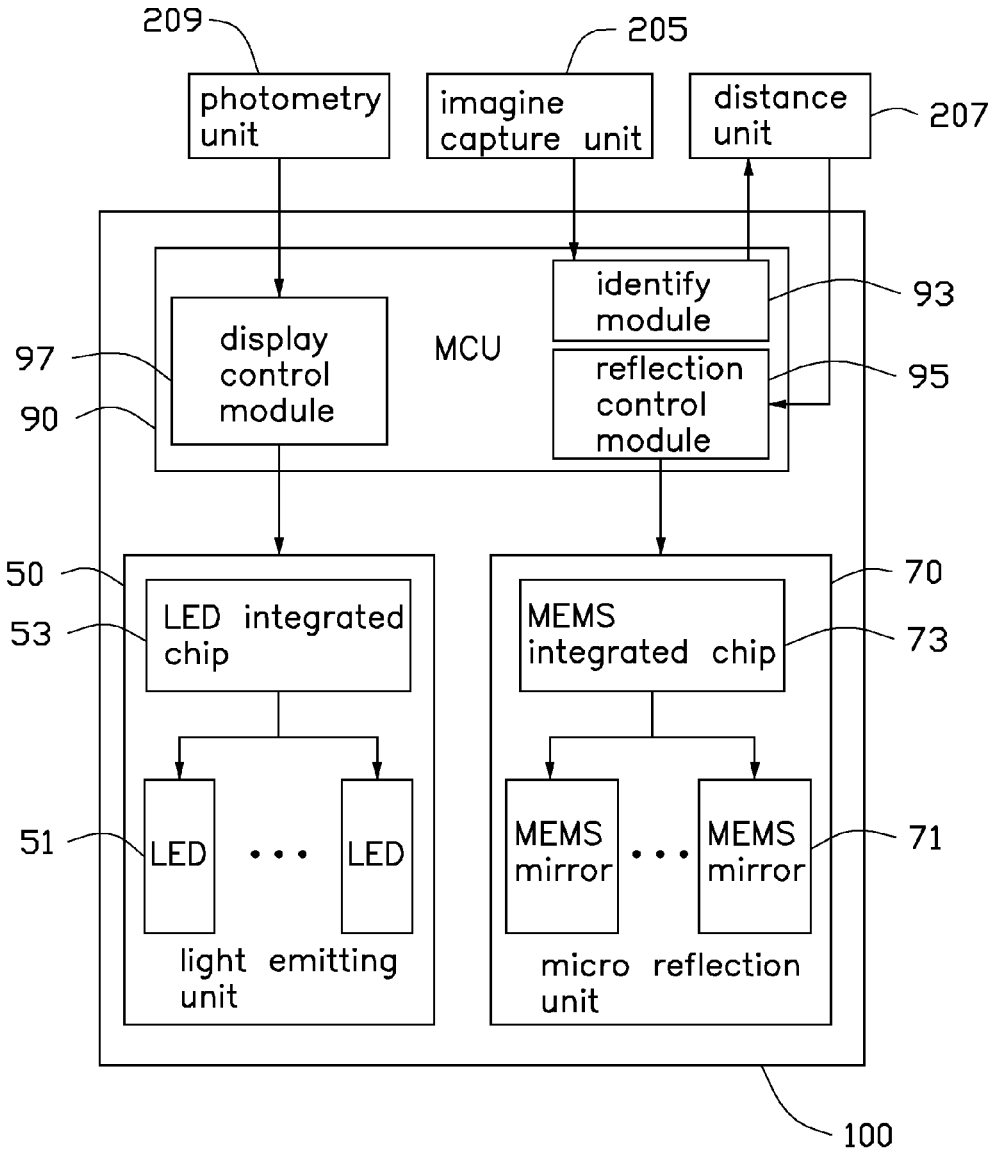
FIG. 2 shows a block diagram of a display module assembly.

FIGS. 1 and 2 show a display device 200 of a first embodiment of the present disclosure. In the illustrated embodiment, the display device 200 is a RGB LED display device. The display device 200 includes a housing 201, a screen 203 mounted on the housing 201, an image capture unit 205, a distance measuring unit 207, a photometry unit 209, and a display module assembly 100 positioned in the housing 201. The imagine capture unit 205, the distance measuring unit 207, and the photometry unit 209 are arranged in a row on the housing 201 located above the screen 203. The imagine capture unit 205, the distance measuring unit 207, and the photometry unit 209 are electrically connected to the display module assembly 100. The distance measuring unit 207 is positioned between the imagine capture unit 205 and the photometry unit 209. The display device 200 includes other functional modules such as circuit boards, and audio module for performing specific functions. For simplicity, other functional modules are not described here.

The display module assembly 100 is received in the housing 201 for displaying images, and adjusting the orientation of the beams of light which constitute the display, and the brightness of the display, according to the position of a viewer's line of sight. The display module assembly 100 includes a light emitting unit 50, a micro reflection unit 70, and a micro control unit 90. The micro control unit 90 is electrically connected to each of the imagine capture unit 205, the distance measuring unit 207, the photometry unit 209, the light emitting unit 50, and the micro reflection unit 70.

The imagine capture unit 205 captures images in the field of view thereof, and transmits the captured image data to the micro control unit 90. In the illustrated embodiment, the imagine capture unit 205 is an image sensor.

The distance measuring unit 207 measures a distance between the eyes of a user or viewer and the display device 200, and transmits the measured distance data to the micro control unit 90. In the illustrated embodiment, the distance measuring unit 207 is a distance sensor.

The photometry unit 209 obtains photo readings for the ambient light brightness that are sensed around the display device 200. In the illustrated embodiment, the photometry unit 209 is a light sensor.

Figure 3:
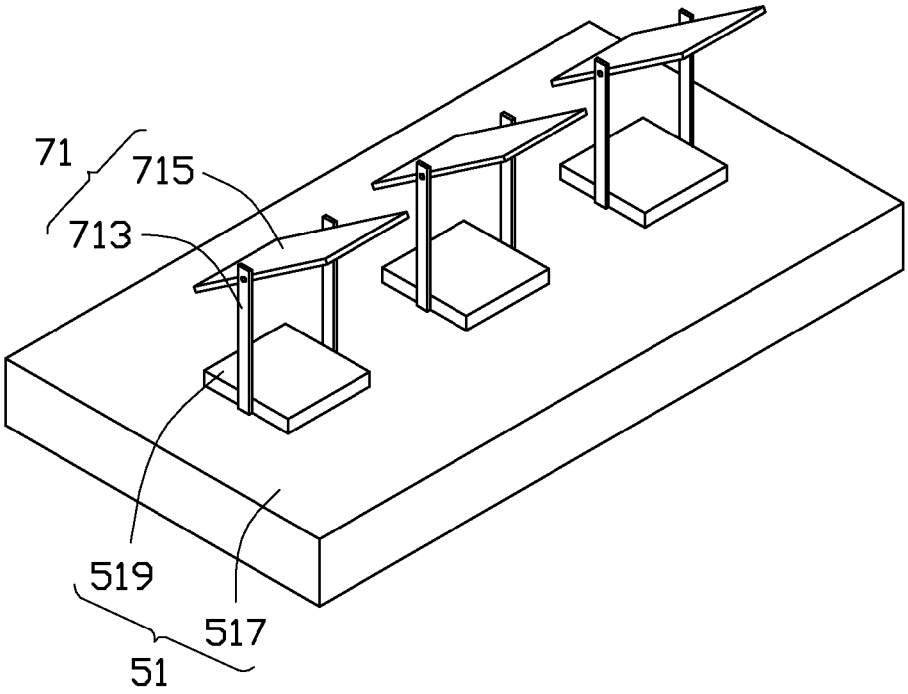
FIG. 3 shows an isometric view of each of the micro-electro-mechanical system mirrors positioned above one LED.

The light emitting unit 50 emits light with certain brightness and color. The light emitting unit 50 includes a plurality of light emitting diodes (LED) 51 and an LED integrated chip 53. Also referring to FIG. 3, in the illustrated embodiment, the plurality of LEDs 51 includes red LEDs, green LEDs, and yellow LEDs. The red LEDs, green LEDs, and yellow LEDs are arranged on a base (not shown) of the light emitting unit 50 in order, and are driven together to form a full-color pixel. Each LED 51 includes a base platform 517 and a light emitting surface 519 positioned on the base platform 517. The base platforms 517 of the LEDs 51 in a same row can be positioned in a row and mounted on the base. In the illustrated embodiments, the directions of light emitted by the light emitting surfaces 519 are parallel to the screen 203. The LED integrated chip 53 is electrically connected to and controlled by the micro control unit 90 to drive the LEDs 51 to work.

The micro reflection unit 70 changes the directions of the transmissions of light emitted by the LEDs 51. The micro reflection unit 70 includes a plurality of micro-electro-mechanical system (MEMS) mirrors 71 and a MEMS integrated chip 73. The plurality of MEMS mirrors 71 that are configured corresponding to the plurality of LEDs 51. Each MEMS mirror 71 includes two support posts 713 and a micro mirror 715. The two support posts 713, being substantially parallel, are positioned on the base platform 517 beside the light emitting surface 519. The micro mirror 715 is rotatably connected between the two support posts 713 above the light emitting surface 519. The MEMS integrated chip 73 is electrically connected to the micro control unit 90 and the plurality of MEMS mirrors 71 to control the micro mirrors 715 to rotate between the support posts 713 for reflecting light into the eyes of a user by being parallel to the line of sight of the viewer, by having adjustable angles. The micro-electro-mechanical system (MEMS) mirrors 71 further include other functional members, such as an actuator driving the MEMS mirrors 71 to rotate, for the sake of simplicity, other functional modules are not described here.

The micro control unit 90 includes an identify module 93, a reflection control module 95, and a display control module 97. The identify module 93 is electrically connected to the imagine capture unit 205 and the distance measuring unit 207. The identify module 93 receives and analyzes the captured image data from the imagine capture unit 205, and makes a determination as to whether the viewer is or is not in front of the display device 200. The identify module 93 stores and restores the captured data concerning the locations of the eyes and the line of sight of the user/viewer and sends an instruction to measure the distance between the eyes of the viewer and the display device 200 to the distance measuring unit 207, if a viewer is deemed to be in front of the display device 200.

The reflection control module 95 is electrically connected to the distance measuring unit 207 and the micro reflection unit 70 to receive the distance data from the distance measuring unit 207. The reflection control module 95 computes the required angles of rotation for each micro mirror 715 to rotate around the support posts 713, and transmits the required angle of rotation to the MEMS integrated chip 73.

The display control module 97 is electrically connected to the photometry unit 209 and the light emitting unit 50 to receive the ambient light brightness data of the display device 200. The display control module 97 adjusts the brightness of the LEDs 51 according to a ratio of the present brightness of the LEDs 51 and that of the ambient environment around the display device 200.

Figure 4:
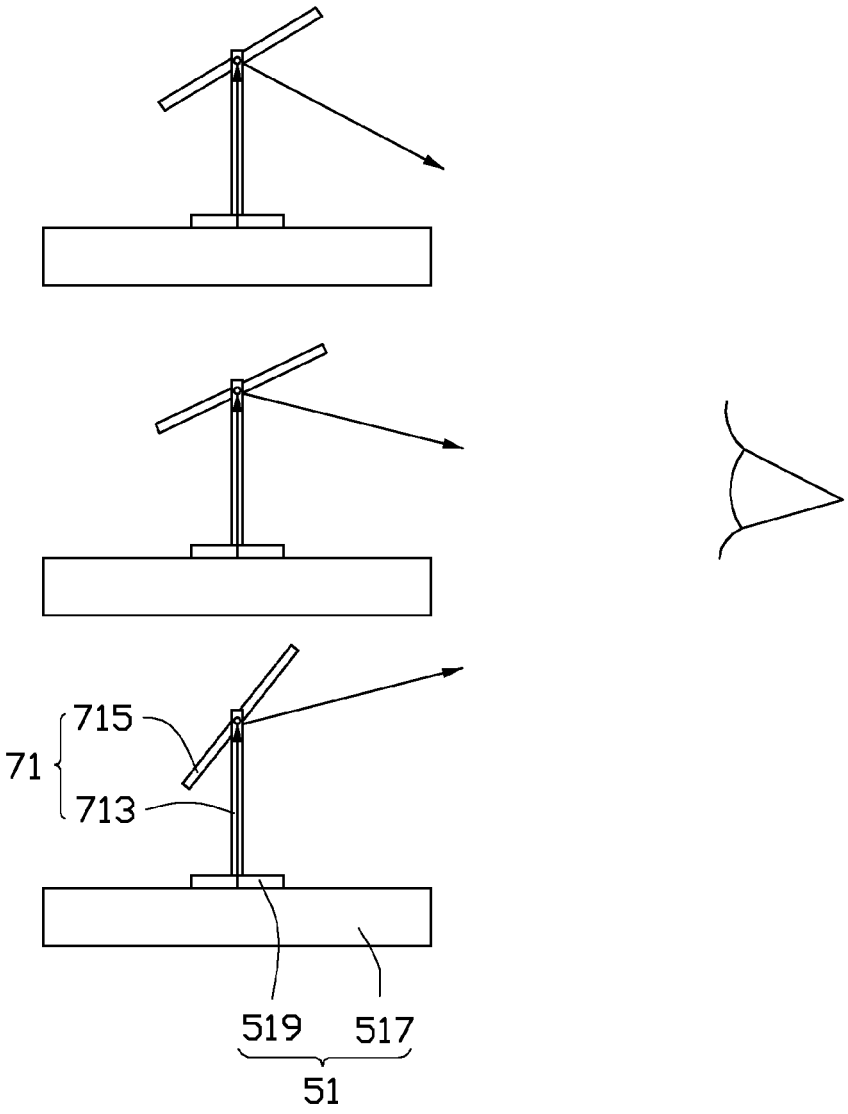
FIG. 4 shows a working state of the micro-electro-mechanical system mirrors and the LEDs without the screen being shown.

In use, the viewer is facing directly in front of the screen 203. The imagine capture unit 205 captures images and transmits the captured data to the identify module 93. The identify module 93 identifies the eye positions and line of sight of the viewer and sends an instruction to measure distance between the eye positions of the viewer and the display device 200, to the distance measuring unit 207. The distance measuring unit 207 measures the distance between the eyes and the display device 200. The reflection control module 95 computes the required angles of rotation for the micro mirrors 715 between the support posts 713 according to the distance data from the distance measuring unit 207. The MEMS integrated chip 73 receives the required angular data, and drives the micro mirrors 715 to rotate a certain amount (as shown in FIG. 4) to reflect light into the eyes of the viewer. The photometry unit 209 obtains the ambient light brightness around the display device 200, and transmits the data for the ambient light brightness to the display control module 97. The display control module 97 computes the required display brightness of the LEDs 51 according to the data of the ambient light brightness, and transmits the required brightness data to the LED integrated chip 53. The LED integrated chip 53 drives the LEDs 51 to adjust their respective illumination brightness.

In alternative embodiments, the photometry unit 209 can be omitted, and the display device 200 does not adjust the display illumination brightness.

In other embodiments, the manner of reflecting the illuminating light emitted by the light emitting surfaces 519 to the eyes of the viewer by means of the MEMS mirrors 71 may be done in other ways. For example, the base platforms 517 are rotatably positioned on a plurality of mounting members (not shown), and each MEMS mirrors 71 is fixedly positioned on one board (not shown) opposite to the light emitting surface 519. The reflection control module 95 computes the required rotation angle of each base platform 517 to rotate around the corresponding mounting member, and the LED integrated chip 53 drives the base platform 517 to rotate accordingly. In that case, the MEMS integrated chip 73 can be omitted, and the support posts 713 can also be omitted.

The imagine capture unit 205 captures images in the field of view thereof, and transmits the captured image data to the identify module 93 to identify the position of the viewer's eyes. The distance measuring unit 207 measures the distance between the eyes of the viewer and the display device 200, and transmits the distance data to the reflection control module 95. The MEMS mirrors 71 of the display device 200 are capable of reflecting light emitted by the LEDs 51 according to the changing position of the eyes of the user or viewer, in real time. Light emitted by the LEDs 51 of portions of the display device 200 which are not positioned precisely in front of the viewer, will also be reflected directly into the eyes of the viewer. Then, the viewer will sense that the brightness of the display from the display device 200 is uniform. The viewing experience will be more comfortable for the viewer. In addition, the photometry unit 209 obtains the ambient light brightness around the display device 200, and transmits the brightness data to the display control module 97. Then the display device 200 can adjust the brightness of the LEDs 51 according to the brightness of the ambient light.

Figure 5:
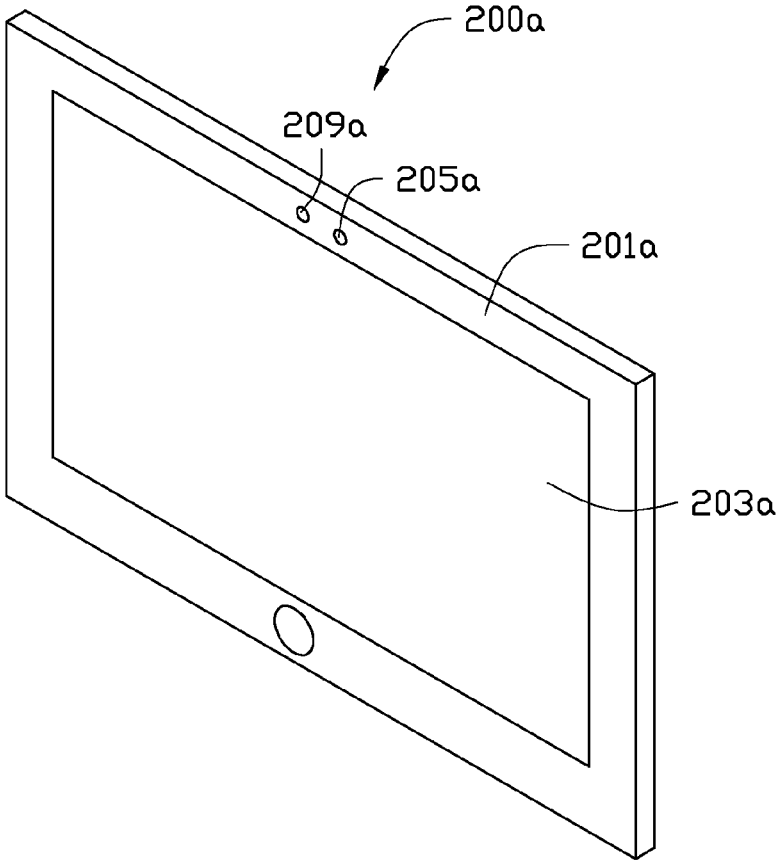
FIG. 5 shows an isometric view of a display device in accordance with a second embodiment of the present disclosure.

In a second embodiment of present disclosure, a structure of a display device 200*a* (shown in FIG. 5) is similar to that of the display device 200 of the first embodiment. The display device 200*a* includes a housing 201*a*, a screen 203*a* mounted on the housing 201*a*, an imagine capture unit 205*a*, a photometry unit 209*a*, and a display module assembly 100*a* (shown in FIG. 6) positioned in the housing 201*a*. The imagine capture unit 205*a* and the photometry unit 209*a* are arranged in a line on the housing 201*a* located above the screen 203*a*. The imagine capture unit 205*a* and the photometry unit 209*a* are electrically connected to the display module assembly 100*a*.

Figure 6:
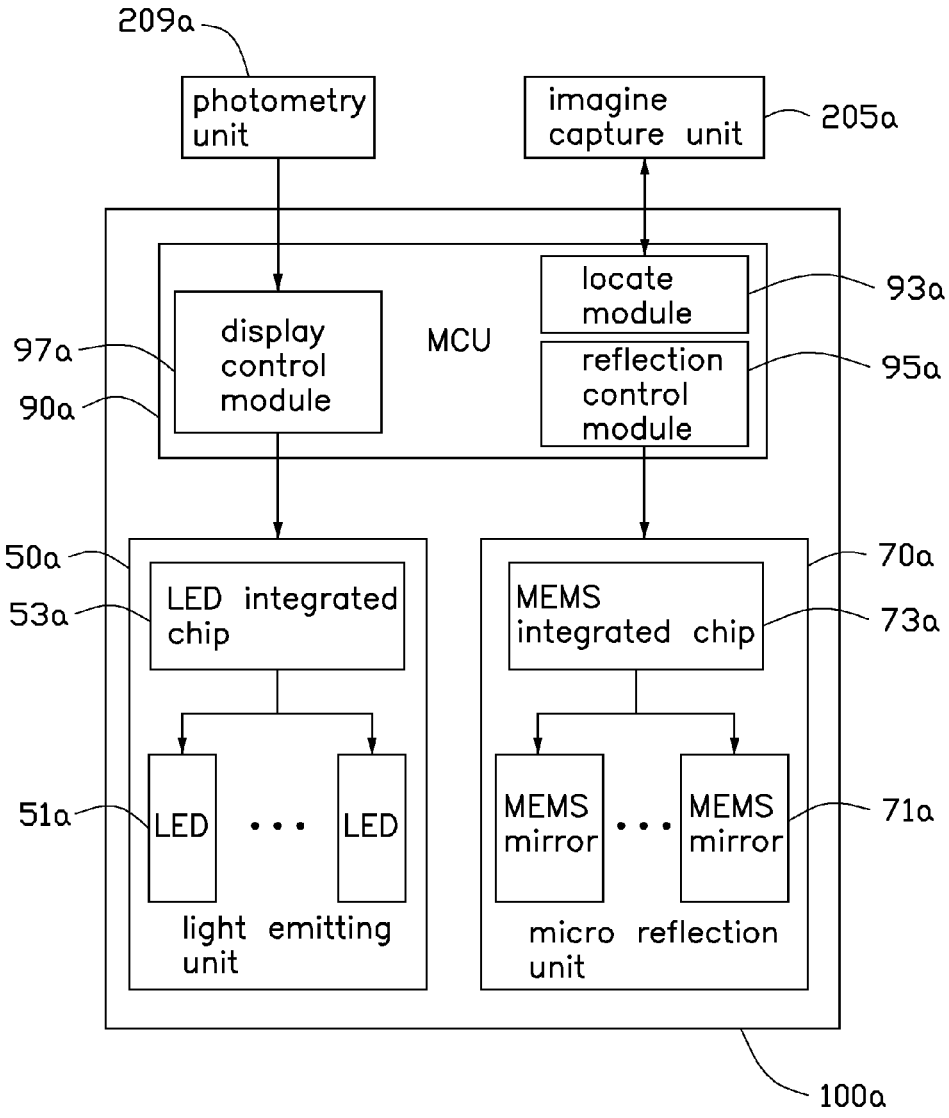
FIG. 6 shows a block diagram of the display module assembly in the second embodiment of the present disclosure.

FIG. 6 shows a display module assembly 100*a*. In the illustrated embodiment, the display module assembly 100*a* is similar to the display module assembly 100 of the first embodiment, but with a different micro control unit 90*a*. The display module assembly 100*a* includes a light emitting unit 50*a*, a micro reflection unit 70*a*, and a micro control unit 90*a*. The imagine capture unit 205*a*, the photometry unit 209*a*, the light emitting unit 50*a*, and the micro reflection unit 70*a* are electrically connected to the micro control unit 90*a*. The light emitting unit 50*a* includes a plurality of LEDs 51*a* and a LED integrated chip 53*a*. The micro reflection unit 70*a* includes a plurality of MEMS mirrors 71*a* and a MEMS integrated chip 73*a*. Each MEMS mirror 71*a* is rotatably positioned on one LED 51*a* and optically coupled with the LED 51*a*. The micro control unit 90*a* includes a locate module 93*a* and a reflection control module 95*a*. The locate module 93*a* is electrically connected to the imagine capture unit 205*a* and the reflection control module 95*a*. The locate module 93*a* receives the captured data from the imagine capture unit 205*a*, and locates the position of the viewer's eyes to determine line of sight. Then the data as to the position of the viewer's eyes is transmitted to the reflection control module 95*a*. The reflection control module 95*a* is electrically connected to the micro reflection unit 70*a* to control the MEMS mirrors 71*a* to rotate relative to the LEDs 51*a*.

It is to be understood, however, that even through numerous characteristics and advantages of the disclosure have been set forth in the foregoing description, together with details of the structure and function of the present disclosure, the disclosure is illustrative only, and changes may be made in detail, especially in the matters of shape, size, and arrangement of parts within the principles of the present disclosure to the full extent indicated by the broad general meaning of the terms in which the appended claims are expressed.

What is claimed is:

1. A display device, comprising:

a housing;

a screen mounted on the housing;

an imagine capture unit positioned on the housing adjacent to the screen, and configured to capture images of a viewer;

a distance measuring unit positioned on the housing adjacent to the screen and spaced from the imagine capture unit, the distance measuring unit configured to measure a distance between the eyes of the viewer and the display device, and a display module assembly comprising a light emitting unit, a micro reflection unit, and a micro control unit, the display module assembly received in the housing, the micro control unit comprising an identify module and a reflection control module, wherein the identify module is electrically connected to the imagine capture unit and the distance measuring unit, the identify module receives image data from the imagine capture unit to identify the position of the eyes of the viewer and sending an instruction to measure the distance between the eyes of the viewer and the display device to the distance measuring unit; the reflection control module is electrically connected to the distance measuring unit to receive the distance data for the distance between the viewer's eyes and the display device; and the reflection control module is further electrically connected to the micro reflection unit to control the micro reflection unit to rotate relative to the light emitting unit, such that light emitted by the light emitting unit is reflected into the eyes of the viewer by being parallel to the line of sight of the viewer.

2. The display device of claim 1, wherein the light emitting unit comprises a plurality of LEDs and an LED integrated chip driving the plurality of LEDs, the micro reflection unit comprises a plurality of micro-electro-mechanical system (MEMS) mirrors and a MEMS integrated chip controlling the micro-electro-mechanical system mirrors, the MEMS integrated chip is electrically connected with the reflection control module; each MEMS mirror is rotatably positioned on one LED; the reflection control module computes the required angles of rotation of each MEMS mirror according to the distance data for the distance between the viewer's eyes and the display device, and transmits the data of the required angles of rotation to the MEMS integrated chip to control each of the MEMS mirrors to rotate relative to the one corresponding LED.

3. The display device of claim 2, wherein each of the MEMS mirrors comprises two support posts and a micro mirror, the two support posts are positioned on one LED, and the micro mirror is rotatably connected between the two support posts, and is optically coupled with the LED.

4. The display device of claim 3, wherein each LED comprises a base platform and a light emitting surface positioned on the base platform, the support posts are positioned on the base platform besides two sides of the light emitting surface and substantially parallel to each other, and the micro mirror is optically coupled with the light emitting surface.

5. The display device of claim 1, wherein further comprises a photometry unit electrically connected to the micro control unit, and the photometry unit is configured to obtain data of environmental light brightness around the display device and to transmit the data of environmental light brightness to the micro control unit.

6. The display device of claim 5, wherein the micro control unit further comprises a display control module electrically connected with the photometry unit and the light emitting unit, and the display control module is configured to adjust the illumination brightness of the light emitting unit according to a ratio of the environmental light brightness around the display device and a present illumination brightness of the light emitting unit.

7. A display device, comprising:

a housing;

a screen mounted on the housing;

an imagine capture unit positioned on the housing adjacent to the screen, and configured to capture images of a viewer; and a display module assembly, received in the housing, comprising a light emitting unit, a micro reflection unit, and a micro control unit, the micro control unit comprising a locate module and a reflection control module, wherein the locate module is electrically connected to the imagine capture unit and the micro reflection unit, the locate module receives image data from the imagine capture unit and determines the position of the eyes of the viewer, the reflection control module is electrically connected to the locate module to receive the position data of the viewer's eyes; and the reflection control module is further electrically connected to one of the light emitting unit and the micro reflection unit to control the micro reflection unit to rotate relative to the light emitting unit, such that light emitted by the light emitting unit is reflecting into the eyes of the viewer by being parallel to the line of sight of the viewer.

8. The display device of claim 7, wherein the light emitting unit comprises a plurality of LEDs and an LED integrated chip driving the plurality of LEDs, the micro reflection unit comprises a plurality of micro-electro-mechanical system (MEMS) mirrors and a MEMS integrated chip driving the micro-electro-mechanical system mirrors, the MEMS integrated chip is electrically connected with the reflection control module; each MEMS mirror is rotatably positioned on one corresponding LED; the reflection control module computes the rotating angles of the MEMS mirrors according to the distance data, and transmits the rotating angular data to the MEMS integrated chip to control each of the MEMS mirrors to rotate relative to the one corresponding LED.

9. The display device of claim 8, wherein each of the MEMS mirrors comprises two support posts and a micro mirror, the two support posts are positioned on one LED, and the micro mirror is rotatably connected between the two support posts, and is optically coupled with the LED.

10. The display device of claim 9, wherein each LED comprises a base platform and a light emitting surface positioned on the base platform, the support posts are positioned and substantially parallel to each other, and the micro mirror is optically coupled with the light emitting surface.

11. The display device of claim 7, wherein further comprises a photometry unit electrically connected with the micro control unit, and the photometry unit is configured to obtain data of environmental light brightness around the display device and to transmit the data of environmental light brightness to the micro control unit.

12. The display device of claim 11, wherein the micro control unit further comprises a display control module electrically connected with the photometry unit and the light emitting unit, and the display control module is configured to adjust the illumination brightness of the light emitting unit according to a ratio of the environmental light brightness around the display device and a present illumination brightness of the light emitting unit.

* * * * *